US008540248B2

(12) United States Patent
Golden

(10) Patent No.: US 8,540,248 B2
(45) Date of Patent: Sep. 24, 2013

(54) CRAPS GAME WITH NOVEL PROPOSITION WAGERS

(76) Inventor: Alan H. Golden, Potomac, MD (US)

( * ) Notice: Subject to any disclaimer, the term of this patent is extended or adjusted under 35 U.S.C. 154(b) by 2339 days.

(21) Appl. No.: 10/926,567

(22) Filed: Aug. 26, 2004

(65) Prior Publication Data

US 2006/0043678 A1 Mar. 2, 2006

(51) Int. Cl.
*A63F 3/08* (2006.01)

(52) U.S. Cl.
USPC ..... 273/274

(58) Field of Classification Search
USPC ..... 273/274
See application file for complete search history.

(56) References Cited

U.S. PATENT DOCUMENTS

| | | | | | |
|---|---|---|---|---|---|
| 4,334,685 | A * | 6/1982 | Robbins et al. | 273/274 |
| 4,902,019 | A * | 2/1990 | Berman | 273/256 |
| 5,308,081 | A * | 5/1994 | Bartle | 273/274 |
| 5,350,175 | A * | 9/1994 | DiLullo et al. | 273/146 |
| 5,487,547 | A * | 1/1996 | Hobert | 273/274 |
| 5,490,670 | A * | 2/1996 | Hobert | 463/20 |
| 5,728,002 | A | 3/1998 | Hobert | 463/17 |
| 5,729,002 | A * | 3/1998 | Samples | 235/462.01 |
| 5,732,948 | A * | 3/1998 | Yoseloff | 273/274 |
| 5,785,596 | A * | 7/1998 | Hobert | 463/22 |
| 5,829,748 | A * | 11/1998 | Moore, Jr. | 273/274 |
| 5,829,749 | A * | 11/1998 | Hobert | 273/274 |
| 5,964,463 | A * | 10/1999 | Moore, Jr. | 273/274 |
| 6,655,689 | B1 * | 12/2003 | Stasi | 273/274 |
| 6,755,420 | B2 * | 6/2004 | Colton | 273/274 |
| 7,100,919 | B2 * | 9/2006 | Stasi | 273/274 |
| 7,175,526 | B2 * | 2/2007 | Moore, Jr. | 463/22 |
| 2001/0042960 | A1 * | 11/2001 | Lewis et al. | 273/274 |
| 2004/0251626 | A1 | 12/2004 | Porter et al. | 273/146 |
| 2005/0179201 | A1 * | 8/2005 | DeSalvo | 273/244.1 |

OTHER PUBLICATIONS

"Craps", European and Asian Games, Syd Helprin, Gambling Times Incorporated, pp. 99-118, 1986.*
"Scarne on Dice", by John Scarne, 1945 7 1946, p. 113.*
Scarne's Encyclopedia of Games, John Scarne, pp. 454-464.*
U.S. Appl. No. 11/039,181, filed Jan. 20, 2005, Cacas.

* cited by examiner

*Primary Examiner* — Kurt Fernstrom
*Assistant Examiner* — Dolores Collins
(74) *Attorney, Agent, or Firm* — Mark A. Litman & Associates, P.A.

(57) ABSTRACT

A casino craps table layout is provided with unique wagering opportunities. There are specific wagering areas for placing a wager on at least one of two new wagering opportunities. These new wagering opportunities are selected from the group consisting of a) a wager that the next roll of the dice will be a hard 4, 6, 8 or 10 and b) a wager that the next roll of the dice will be a pair of numbers. Another new wagering opportunity is a placed wager for any specific number (e.g., 4, 5, 6, 8, 9, and 10).

16 Claims, 2 Drawing Sheets

CRAPS GAME WITH NOVEL PROPOSITION WAGERS

BACKGROUND OF THE INVENTION

1. Field of the Invention

The present invention relates to the field of casino table dice, casino table dice games where a player's wager is determined by a throw of dice, and a craps-type casino table dice game providing a non-standard proposition wager that is available to players on the table.

2. Background of the Art

Craps is one of the oldest forms of wagering, and is based upon rigid probabilities for the occurrence of specific combinations of dice faces being exposed after a roll. There are 36 possible combinations of dice faces that may appear in the roll of two dice with six faces identified with values of 1, 2, 3, 4, 5, and 6. The combinations of values or count (and number of combinations that provide those values) are 2(1), 3(2), 4(3), 5(4), 6(5), 7(6), 8(5), 9(4), 10(3), 11(2) and 12(1). This statistical breakdown shows there are thirty-six (36) combinations of dice, and the probabilities of events assists in determining the odds provided by the house on each throw of the dice and the overall odds and house hold percentage on every wager made at the craps table. The available wagers have been known for many years, and few additional wagers or additional table displays have been added to standard craps games over the years. One of the few newer additions to craps table displays (printing on the surface of the felt table top) has been the provision of specific boxes for placement of hopping bets at the table. The boxes consist of a box for every dice combination (except 1-1, 1-2, 6-5 and 6-6, which are, in effect, hopping bets and have available betting boxes on the table) where wagers can be placed on that specific event. The nature of wagering at the craps table will be described in greater detail in the Detailed Description of the Invention.

If the player throws a preselected winning combination, such as a 4-5-6, triple, or pair and a 6, the shooter wins. If the shooter throws a preselected losing combination, such as a 1-2-3 or a pair and a one, the shooter loses. If the shooter throws a third combination, such as a pair and a 2-3-4 or 5, then the player throws in an attempt to beat the shooter. If the player throws a preselected combination, such as a 4-5-6, or a pair and single die having a value higher than that of the shooter, the player wins. If the player throws a preselected loser, such as a 1-2-3, or a pair and single die having a value less than that of the shooter, the player loses. If the player or shooter does not throw one of above stated winning or losing combinations, then the shooter or player must throw again. Each player may place a second bet that the outcome of the game will result in predetermined winning die combination yielding a predetermined winning payout. A player may also place bonus bet means, wherein if that particular throw results in a preselected combination, such as triple sixes, the player is entitled to a throw. If the player throws another preselected combination, such as a triple six, the player is entitled to a large winning payout.

U.S. Pat. No. 5,487,547 describes a wagering method and betting table for craps with a progressive bet or jackpot bet provided for a specific number and type of consecutive doubles being rolled. Specifically, the progressive wager is for doubles 2, 4, 6, 8, 10 and 12 being rolled in any order with no other rolls being present.

U.S. Pat. No. 5,490,670 describes a layout and method of play of the game of craps wherein a pair of dice is used, the dice being of a size for manually rolling to present one of eleven different numbers which define a plurality of point numbers, at least one natural number, and at least one craps number. A gaming layout provides a flat surface upon which said dice may be rolled and upon which bets may be laid by physical placement of wagers, said flat surface including indicia thereon representing a plurality of wager areas, said wager areas including:

(a) a pass line area for receiving a wager betting both (i) that one or more rolls of dice will yield an established first point number without rolling the number "7"; and (ii) that a natural number is rolled prior to establishing the first point number or prior to rolling a craps number;

(b) a don't pass area for receiving a wager betting both (i) that one or more rolls of the dice will yield the number "7" prior to the rolling of an established first point number; and (ii) that a craps number is rolled prior to establishing the first point number or prior to rolling a natural number; and (c) a jackpot area for receiving a wager that a set of a plurality of dice outcomes are rolled, said set having a remote probability of occurrence, and said set being randomly generated at a certain point in the play.

U.S. Pat. No. 5,728,002 describes a craps game is disclosed that incorporates a jackpot wagering area in a traditional craps game. In the jackpot wagering area, a player may make a bet that covers multiple wagers, including at least one jackpot sequence wager that a jackpot sequence of dice outcomes will be rolled. The jackpot sequence has a relatively remote possibility of occurrence and, correspondingly, a high payoff. A jackpot wagering area bet covers wagers in addition to the jackpot sequence wager. For example, the bet may also cover an additional jackpot sequence wager, a lower payoff sequence wager, or a traditional craps wager.

U.S. Pat. No. 5,829,749 describes a method of playing a craps game is disclosed that incorporates a jackpot wagering area in a traditional craps game. The method includes receiving a bet that a jackpot sequence of dice outcomes will be rolled. The jackpot sequence has a relatively remote possibility of occurrence and, correspondingly, a high payoff. A jackpot wagering area bet may cover wagers in addition to the jackpot sequence wager. For example, the bet may also cover an additional jackpot sequence wager, a lower payoff sequence wager, or a traditional craps wager. Also, the method of playing a craps game with a jackpot sequence wager may be played on a video screen.

U.S. Pat. No. 6,655,689 describes a proposition bet for Craps referred to as a FIRE BET™ The method includes predetermining a schedule of a pay-out table, players placing FIRE BET™ wagers at respective player betting areas prior to a shooter's initial come out; accumulating points responsive to outcomes of the shooter's dice throws, wherein points are made when a number 4, 5, 6, 8, 9 or 10 is twice rolled before sevening out, and wherein repeating of any made number is ignored, and making a pay-out based upon the points accumulated and the schedule.

It would be desirable to add additional wagers and especially additional proposition wagers to the play at a craps table to add interest and excitement to the game, to increase potential winnings or house hold, and to advance the game of craps.

SUMMARY OF THE INVENTION

In addition to the standard wagers available in the play of the game of craps, the game would also include at least one of the new proposition wagers of "Any Hard Ways" or "Any Doubles." These proposition wagers may also be provided as a running wager at different odds than provided as a proposition wager. These wagers could be specifically identified by boxes printed on the table cover to identify the placement of the wager(s) and the odds for the wager. For example, Any Hard Ways could be posted at payout odds of "7 to 1" as the probability of the event is 1/9. Similarly, the Any Doubles could be posted at "4:1" as the probability of the event is 1/6. A Place 6 or Place 8 wager may be made by the players (as opposed to the house placing a wager on the 6 or the 8) in a specially marked wagering area. Additional odds may or may not be placeable by the casino on the Place 6 and Place 8 wagers before or after a 6 or 8 has been rolled. Specific wagers on any point number (4, 5, 6, 8, 9, and 10) may also be made available for the player.

DETAILED DESCRIPTION OF THE INVENTION

Figure 1:
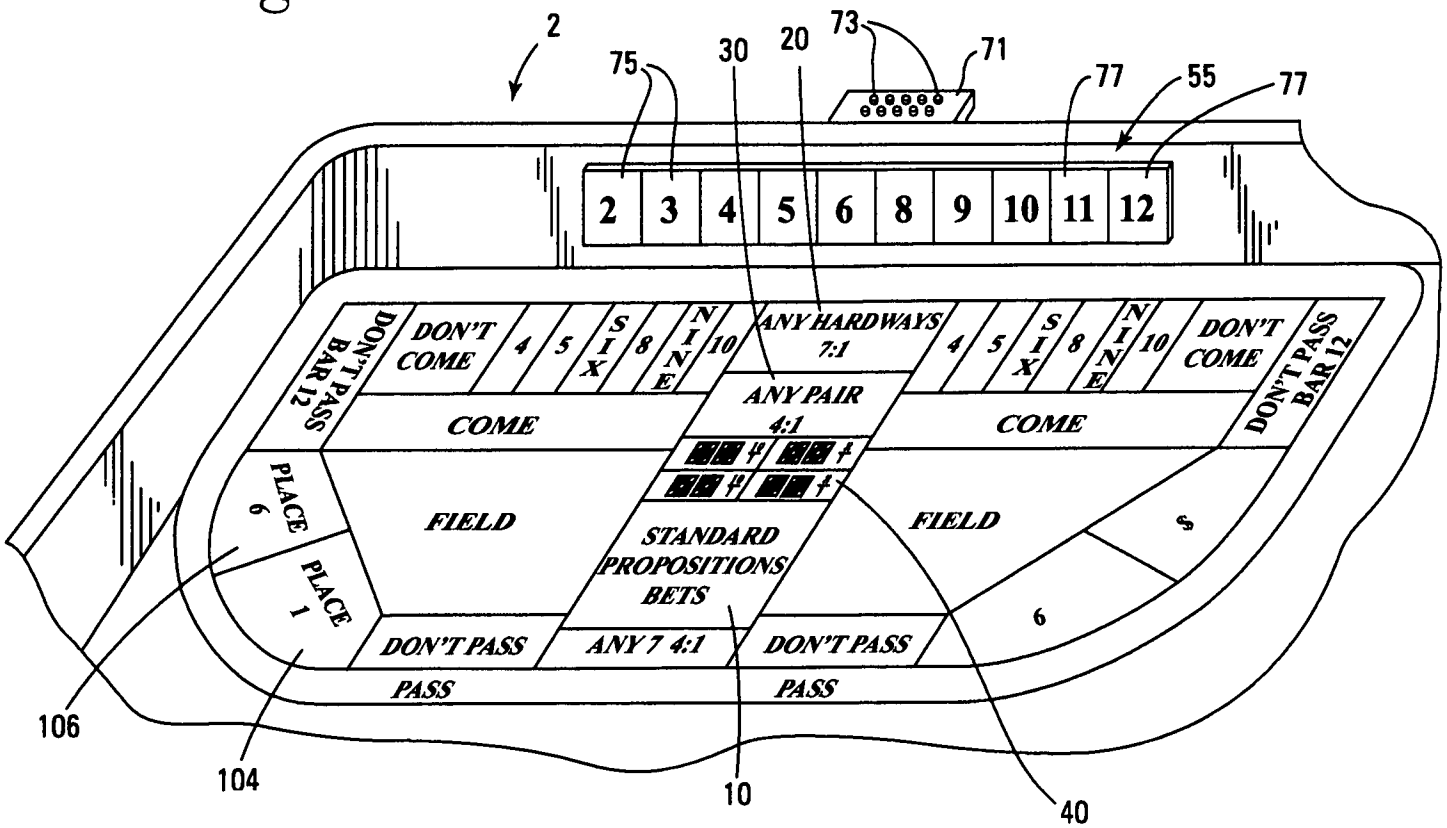
FIG. 1 shows a game table layout that is useful in the practice of the present invention.

The game of this disclosure takes the basic play of the conventional table game of craps and adds one or two additional proposition wagers to the game. The game is preferably played using a standard craps table layout with special wagering boxes for the new wagers. All examples will be described and all percentages will be described based on the use of standard six faced dice.

General Rules for Play of Craps.

Each player is afforded the opportunity to place a wager on the table in a similar fashion to the standard wagers placed on a standard craps table. These areas will be duly identified and described below.

In essence, the player places at least one of the various wagers indicated below before the dice are thrown by the shooter. A shooter, the person throwing the dice, must have at least one minimum wager (on the "pass" or "don't pass" line) on the table, although a partner may throw the dice for someone else placing the wager. As the pair of dice provides 36 possible outcomes for a single roll of one standard pair of dice, there are 36 possible outcomes on each and every roll of the dice in the standard game of craps. The standard wagers include:

PASS LINE Wager:

1) The player will lose on a shooter opening throw totaling 2, 3, or 12, and will lose all money wagered on this area.
2) The player will win on a shooter opening throw totaling 7 or 11, and will win on a 1 to 1 payout basis.

This means that the player will either win or lose on a throw of 2, 3, 7, 11, or 12. If none of these values appears for the shooter, then a POINT would be established, and these possible numbers are as follows: 4, 5, 6, 8, 9, or 10. Assuming that the throw established a POINT, the players with a wager on the pass line would be hoping for the shooter on any subsequent throw to obtain this same sum total of the POINT, before obtaining a sum total of 7. Remember that the shooter's first throw only represents the total to be used for the POINT or come out throw establishing a point, or winning (with a 7 or 11) or losing with a craps (2, 3 or 12).

3) Also, the players who have wagered on the PASS LINE, may make an additional wager after the POINT is established, and before any subsequent throwing of the cards. This is called TAKING the odds, and the odds and payouts for this additional wager are as follows:

| POINT | PAYOUT |
|---|---|
| 6 or 8 | 6 to 5 |
| 5 or 9 | 3 to 2 |
| 4 or 10 | 2 to 1 |

The taking of the odds is one of the best wagers in the casino, with a house hold of only about 0.8% of the total money wagered.

4) Again, a player who wagered on the pass line, and made this additional wager as well, would be looking for the shooter to obtain a two card total on any subsequent throw to total the established POINT. If this occurs, the player would receive a payout of 1 to 1 on the original pass line wager, and receive the odds as stated above for the additional TAKING of the odds wager.
5) However, if after establishing the POINT, the shooters count on a throw is a count of total 7 on any subsequent throw prior to the shooter making the POINT as described above, the player would lose all money wagered on the pass line, as well as all additional money wagered on this particular established POINT (the TAKING of the odds).
6) Once either the POINT is made, or the shooter's throw totals 7 after the POINT is established, all bets would be settled, and this would signify the end of that portion of play for that particular established POINT. The shooter on the next throw would be looking again to establish a "new" POINT for the players.

DON'T PASS LINE:

This phase of the craps game (wagering area) for the players is exactly the opposite of that described for the PASS LINE section as described above. The only major difference (again realizing that pass line is opposite of don't pass line) is that players wagering on the DON'T PASS LINE do not win if the shooter's opening throw is a 12, whereas PASS LINE players do in fact lose if the shooter's opening throw is a 12. A wager placed on this area of the table by the player, would take on a payout similar to the PASS LINE, and would be 1 to 1 if the shooter's opening throw (before the establishment of the point is a 2 or 3. However, if the shooter's opening throw is a 7 or 11, then the player would lose all of his or her wager on this area of the table. Once again, an opening throw of 12 would mean nothing to the players who have wagered on the DON'T PASS LINE, if there is a DON'T PASS BAR 12 rule in effect, which there always is (or a BAR 2), as the probabilities would favor the player without the BAR provision.

Working in a similar (but opposite) fashion as the PASS LINE, once the POINT is established, the player wagering on the DON'T PASS LINE would be looking for the shooter to obtain a total of 7 on subsequent throws, before obtaining a total equal to the established POINT. If the shooter on any subsequent throw attains a total of 7 before attaining the established POINT, the player would win and would receive a payout of 1 to 1 on the initial DON'T PASS LINE wager.

Just as with the PASS LINE player has the opportunity to place an additional wager down once the POINT is established, the DON'T PASS LINE player is afforded the same opportunity. The DON'T PASS LINE player can LAY the odds, and the odds and payouts for this additional wager are as follows:

| POINT | PAYOUT |
|---|---|
| 6 or 8 | 5 to 6 |
| 5 or 9 | 2 to 3 |
| 4 or 10 | 1 to 2 |

Again, the player who wagered on the DON'T PASS LINE, and made this additional wager, would be looking for the shooter to obtain a two card total on any subsequent throw of seven. If this occurs, the player would receive a payout of 1 to 1 on the original DON'T PASS LINE wager, and receive the odds as stated above for the additional laying of the odds wager.

However, after establishing the POINT, if on any subsequent throw, the shooter's first and next two cards total equals the established POINT, and prior to the shooter obtaining a first throw total of 7 as described above, the player would lose all money wagered on the DON'T PASS LINE, as well as any and all additional money wagered on this particular established POINT (the LAYING of the odds).

Once either the POINT is made, or the shooter's first two cards total 7 after the POINT is established, all bets would be settled, and this would signify the end of that portion or play for that particular established POINT. The shooter on the house's next throw would be looking to establish a "new" POINT for the players. Basically a "new" round of craps is played.

Players wagering on the DON'T PASS LINE can take their entire wager (including any LAY wager placed) down at any time during the course of play, as long as there have been no dice thrown.

COME and DON'T COME (these areas will be described together, and can only be made after the POINT has been established):

The COME area is similar to the PASS LINE wager (refer to the PASS LINE description of play). However, these wagers can only be placed after the POINT is established. In essence any and all players making a COME wager, are looking for the shooter to in essence establish another POINT for them. All of the same rules apply as far as throws of 2, 3, 7, 11, or 12 are concerned. Furthermore, all of the same rules apply as far as this additional POINT is concerned. The DON'T COME area is similar to the DON'T PASS LINE wager (refer to the DON'T PASS LINE description of play). However, these wagers can only be placed after the POINT is established. In essence any and all players making a DON'T COME wager, are looking for the shooter to establish another additional point for them. All of the same rules apply as far as throws of 2, 3, 7, 11, or 12 are concerned. Furthermore, all of the same rules apply as far as this additional POINT is concerned.

FIELD Bet:

Players may also play the FIELD. This is a one throw wager where the player receives a 1 to 1 payout if the shooter's first two cards on the very next throw total 3, 4, 9, 10, or 11. Some casinos will replace the 9 with the 5 and vice versa. This is a choice reserved by the house, and does not impact the integrity of the game of the invention. Whether the number 5 or 9 is included in the field, would be pre-established, and noted on each and every table so that all players would be fully aware of the numbers making up the FIELD wager. Also included in the FIELD wager and payout would be a shooter total of 2 or 12 on the shooter's first two cards of the very next throw. Under these scenarios, the payout would be as follows:

| NUMBER | PAYOUT |
|---|---|
| 2 | 2 to 1 |
| 12 | 3 to 1 |

The FIELD wager is also a one throw wager, and the player will win as described above. However, any other first two card total obtained by the shooter (other than that identified by the FIELD and displayed on the table layout) will result in a player loss of the entire wager placed. All of the field wagers are settled on each and every round of throwing. Hence, this is a one throw wager, with the player either winning or losing on each throw.

PLACE (or BUY) and LAY Wagering:

A player wishing to PLACE a wager on any of the following numbers: 4, 5, 6, 8, 9, or 10, may do so at any time, and before any cards are thrown for a particular round of throwing. Players placing (or buying) a wager on a particular number are looking for the shooter's first throw on any subsequent throw to total the number the wager was placed on. This wager will remain active until such time that the shooter's next throw totals the number the wager was placed on, or a 7. Any other total obtained by the shooter would be irrelevant to the player making this wager, and the wager would remain on the table, unless the player indicates to take the wager down (or turn the wager off). The player can take their wager down (or turn off their wager) at any time during the course of play, as long as no dice have been thrown to begin a new round of throwing.

If the shooter's first and next two cards total the number the player placed the wager, then the player would win and be paid according to the below payout table:

| NUMBER | PLACE PAYOUT | BUY (plus 5%) PAYOUT |
|---|---|---|
| 4 or 10 | 9 to 5 | 2 to 1 |
| 5 or 9 | 7 to 5 | 3 to 2 |
| 6 or 8 | 7 to 6 | 6 to 5 |

However, if the shooter's first and next throw totals a seven, any and all players who have made a PLACE (or BUY) wager would lose the entire amount wagered. Remembering that all other numbers aside from a 7 or the number the PLACE (or BUY) wager was made are inconsequential to this wager, and the wager will remain active for the next round of throwing, unless the player decides to take the wager down (or turn the wager off).

A player BUYING a number would have to place a desired wager plus 5% to obtain the odds in the far right column as stated directly above. The additional 5% would go directly to the house. Therefore, if the player desired to BUY the 5 for $10.00, they would have to give the shooter $10.50. The $10.00 would be placed on the 5, and the player would receive a payout of 3 to 2 on this $10.00, should the player win. The $0.50 would be retained by the house, and will not be included in any payout calculation.

LAY Wagering:

A player wishing to LAY a wager on any of the following numbers: 4, 5, 6, 8, 9, or 10, may do so at any time, and before any dice are thrown for a particular round of throwing. Players laying a wager on a particular number are looking for the shooter's first throw subsequent to a roll to total a 7. This wager will remain active until such time that the shooter's first and next throw totals the number the wager was placed on, or a 7. Any other total obtained by the shooter would be irrelevant to the player making this wager, and the wager would remain on the table, unless the player indicates to take the wager down. The player can take their wager down at any time during the course of play, as long as no dice have been thrown to begin a new round of throwing.

If the shooter's first and next throw totals 7, then the player would win, and be paid according to the below payout table:

| NUMBER | LAY (plus 5%) PAYOUT |
|---|---|
| 4 or 10 | 1 to 2 |
| 5 or 9 | 2 to 3 |
| 6 or 8 | 5 to 6 |

However, if the shooter's next throw totals the number the LAY wager was placed on, the player loses the entire amount wagered. Remembering that all other numbers aside from a 7 or the number the LAY wager was made are inconsequential to this wager, and the wager will remain active for the next round of throwing, unless the player decides to take the wager down (or turn the wager off).

A player LAYING a number, would have to place down a desired wager plus 5%. The additional 5% would go directly to the house. Therefore, if the player desired to LAY the 5 for $10.00, they would have to give the shooter $10.50. The $10.00 would be placed behind the 5, and the player would receive a payout of 2 to 3 on this $10.00, should the player win. The $0.50 would be retained by the house, and will not be included in any payout calculation.

Standard Proposition Wagers

In wagering on the standard proposition bets at the craps table, a player makes a wager as to the occurrence of a specific event on the next single roll of the dice. The player can only win if the sum of the shooter's first (next) throw of the dice is the exact number his or her wager was placed on, for example, with odds typically as follows:

| | WAGER PLACED | PAYOUT |
|---|---|---|
| | 2 | 30 to 1 |
| | 12 | 30 to 1 |
| | 3 | 15 to 1 |
| | 11 | 15 to 1 |
| | 2 & 12 | 15 to 1 |
| | 2 & 3 | 9 to 1 |
| | 11 & 12 | 9 to 1 |
| | 3 & 11 | 7 to 1 |
| (Horn) | 2, 3, 11, & 12 | 4 to 1 |

According to the present teachings, individual boxes may be provided for wagers that are ordinarily split into separate wagers or placed across lines separating the wagers, such as 2 & 12 (high/low) is a bet (with ½ the total wager on 2, and ½ the total wager on 12), similarly wagers are placed (and have to be split) on a prop bet on a 2 and a 3 on the next roll or on an 11 or 12 (Referred to as E.T., eleven-twelve) which is split or placed on the line separating the 11 and 12 in the prop bet area. "Any Craps" and Three-Way craps bets can be placed. These odds and payouts must be clearly marked on the table so that all players are aware of the exact odds, as the odds may vary slightly at different casinos or even at different table.

In addition to these standard wagers (and others, such as BIG 6 or BIG 8, hopping wagers, "Big Red" (any seven), Three-Way Seven, and the like, that may be present on a casino craps table or electronic version thereof, the present invention advances the "Hard Way" bets that are a special circumstance on the craps table. The hard way combinations are point numbers that are made in dice pairs. When a bet is placed on a specific hard way combination, the bet is against both the 7 and the "easy (or soft) ways" for that specific number. These bets stand until paid, or lost via 7 or an easy way of the same point . . . they are not one-roll bets. The true odds of making a hard 6 or 8 are 10 to 1, but the casino pays 9 to 1, a 9.09% house edge over the real odds. The true odds of making a hard 4 or 10 are 8 to 1, but the casino pays 7 to 1, an 11.11% house edge. These are profitable bets for the casino, and their presence on the table probably induces much higher profit (for the casino) betting by all but the most sophisticated gamblers. "Hop" bets are one roll bets on point numbers, but are often ill-defined (or not defined at all), and can be bet on a specific (or more than one) combination of the dice, usually a single value, such as a hopping eight, which might be only dice combinations of 6-2 and 5-3 or may also include 4-4, which would be reflected in the odds. The true odds of the novel bet of this disclosure, the "ANY HARD WAY" wager, coming up on the next roll of the dice (any one of the following: hard 4, hard 6, hard 8, hard 10) are 8 to 1, and the casino pays 7 to 1, an 11.11% house edge. Since this is a one roll bet with four chances of winning, it would be very attractive to bettors. Either a box in the center of the "hard ways" square, or a single box or a pair of boxes above, below and on either side of the hard way box, labeled "ANY HARD WAY" with the payoff odds (7 to 1).

Considering the preceding Any Hard Ways wager, the bet on "ANY HARD WAY", there are 4 possible combinations of the dice on any given roll that would produce a win. If the other non-point number pairs are added to these, the 2 and 12, an "ANY PAIR" wager would be constructed. This gives six possible winning combinations (out of 36), with true odds of 5 to 1. Since the casino pays this bet at 4 to 1 odds, the house edge is 16.67%. This is the same number of combinations equal to the roll of a seven, which is also paid at the same rate, with the identical house edge. Along with "any 7", this is highest house edge on payouts. This would not be ignored for its profit potential, yet it has the appearance of a reasonable range wager and payout potential. However, so that players may be induced into making the bet (and "pairs or hard ways" are among the most popular "favorite" bets), graphics for the wager must be placed on the table layout. A good position would either be a box in between the "hard ways" box and the "Horn" box. As well, a pair of boxes can be placed either centrally or laterally to the "ANY HARD WAY" box. The box should be labeled "ANY PAIR", with posted payout odds of "4 to 1".

The player may also make a wager on "any number" by having the house place a wager on any specific number of 4, 5, 6, 8, 9, and 10 on the table. These any number wagers provide odds at the table odds rate (e.g., 4 and 10 at 2:1, 5 and 9 at 3:2 and 6 and 8 at 6:5. These wagers may be withdrawn by the player at any time.

FIG. 1 shows a game table layout 2 in a cutaway view that can be used, for example, in an electronically enhanced version of the game of craps. The standard proposition wagers 10 would be shown on the table cover, as would the ANY HARD WAYS placement area 20, the ANY PAIR placement area 30, and the standard Hard Ways wager area 40. An electronic display panel 55 is shown that can display the individual rolls of the dice when they are entered into a croupier controlled input box 71 by pressing buttons 73. The individual numbers (e.g., 75 and 77) would be lit up so that players could better read what the last throw of the dice was.

Although specific details have been provided in the description of the play of the present games, those skilled in the art will appreciate that alternatives, equivalents and other variations are still within the general teachings of the invention. The specific teachings should not be considered as absolutely limiting in the scope of the invention. For example, smart tables are now being developed in which video screens portray all cards being played in a virtual format. Both shooter's cards and player's cards are provided in image form, with the software in a computer(s) managing all elements of the game, including rules, card randomness, wagering, crediting payouts, simulating shooters, and the like. For example, such add-on systems such as event history display devices shown in U.S. Pat. No. 5,934,676 may be used, as may progressive jackpot wagers.

As opposed to "Hop" bets, which can be any single combination of dice for a single roll bet, a set of bets for "ANY POINT NUMBER" can be provided on the table. This would be a single roll bet on any separate number, with "any" combination paying off. Odds would be different for each point number. (This refers to the point numbers, since "CRAPS" and "ELEVEN" and "SEVEN" have their own "any" bets). Corresponding numbers with the same number of combinations would have the same payoff, just like the numbers themselves (as "place" or "come" bets), according to the following chart:

| Number | True Odds | Casino Pays | House Edge |
|---|---|---|---|
| "ANY 4" or "ANY 10" | 11 to 1 | 10 to 1 | 10.09% |
| (4 or 10 can be paid at 9 to 1, for a 12.23% House Edge) | | | |
| "ANY 5" or "ANY 9" | 8 to 1 | 7 to 1 | 11.11% |
| "ANY 6" or "ANY 8" | 7.2 to 1 | 6 to 1 | 12% |
| (6 or 8 can be paid at 5 to 1, for a 14.4% House Edge) | | | |

Again, with these bets displayed ON THE TABLE, the inducement for players to make these bets is higher. The suggestion of the present technology is to provide the players with the ability to go with the "ANY HARD WAY" and "ANY PAIR" as described herein.

A standard craps table layout contains the "BIG 6" and "BIG 8" in the corner farthest from the boxman position. It is little used, because the original payout for the bettor is even money, while the same bet "placed" by the dealer is paid at 7 to 6 odds. As it is a clear disadvantage for the bettor against the house, few knowledgeable bettors use it anymore. There are a number of casinos that do pay the winning bet at "place" odds, but this is done on an irregular basis.

It is proposed within this disclosure to substitute or split those wager position boxes with "PLACE 6" and "PLACE 8" boxes in the same positions. While these pay exactly the same odds as the corresponding place bets, they then become "self-service" bets. Since "placing" the 6 and 8 are among the most common bets on the craps table, this would be a minor labor-saving device for the dealers, and, being less intimidating to the novice bettor, may induce more betting, which is definitely in the house's interests.

Figure 2:
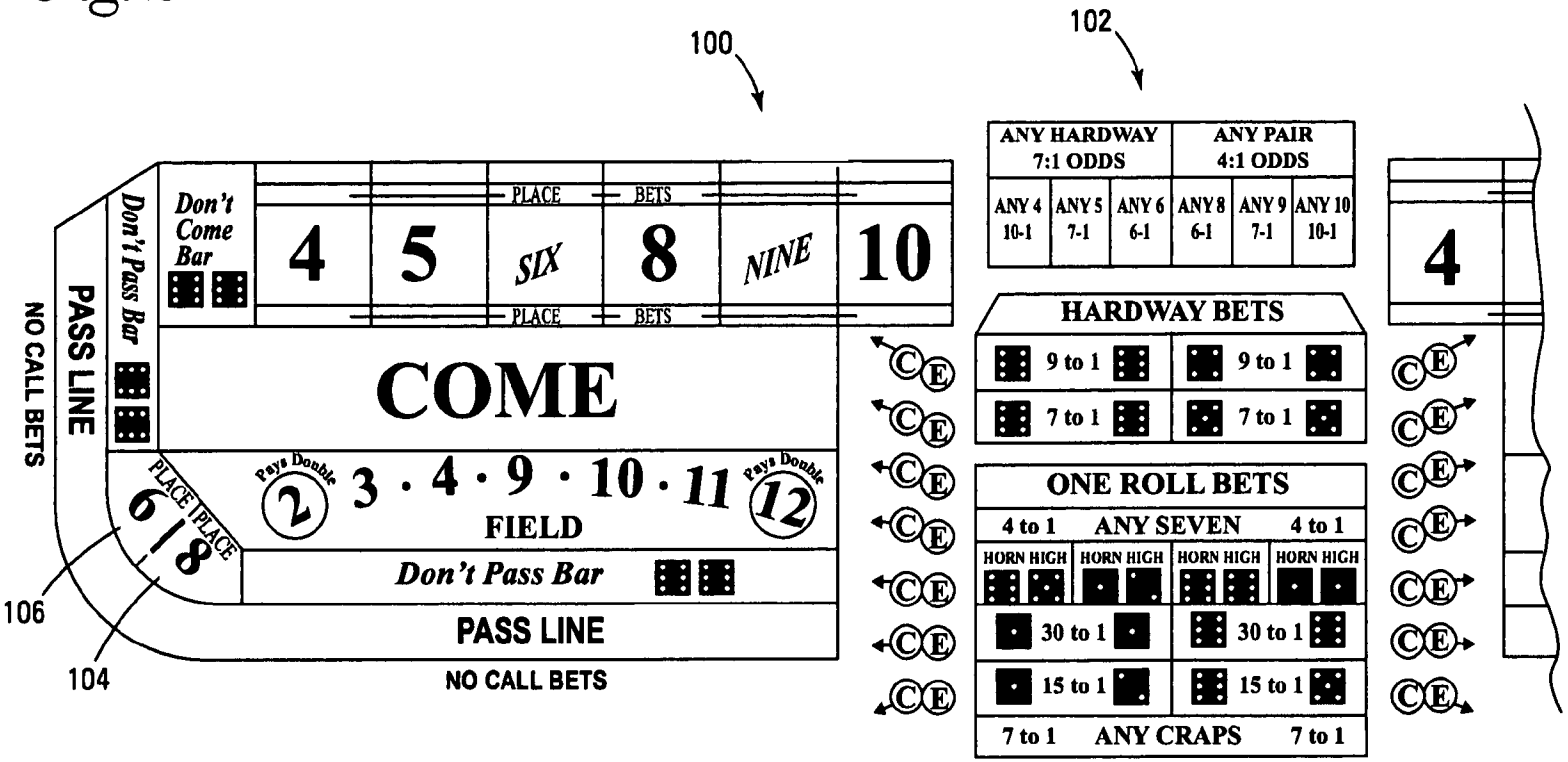
FIG. 2 shows a cutaway view of a casino table top with the position available for a Place 6 or Place 8 wager according to an alternative embodiment of one element of the present description.

FIG. 2 shows a cutaway of a casino table layout 100 with the special proposition wagers 102 and the Place 8 and Place 6 wager boxes 104 and 106 shown in addition to samples of standard wager box features.

What is claimed is:

1. In the method of play of a game of craps, wherein at least one player places a proposition wager on random events generated by dice, and random dice outcomes are provided, the improvement comprising providing a player at least one wagering opportunity on a single roll of the dice selected from the group consisting of a) a wager that the next roll of the dice will be a hard 4, 6, 8 or 10; and b) a wager that the next roll of the dice will be any pair of numbers; and a player placing a wager on at least one of the at least one wagering opportunities.

2. The method of claim 1 wherein a proposition wager opportunity is present that provides a wager opportunity that provides odds for the hard 4, 6, 8, and 10 between 6:1 and 8:1 on a single roll of the dice.

3. The method of claim 2 wherein odds for a) are offered and odds for b) is not offered.

4. The method of claim 1 wherein a wager opportunity is present that provides odds for the pair of numbers between 3:1 and 5:1 on a single roll of the dice.

5. The method of claim 4 wherein odds for b) are offered and odds for a) is not offered.

6. The method of claim 1 wherein a wager opportunity is present that provides odds at for the hard 4, 6, 8, and 10 at 7:1 on a single roll of the dice.

7. The method of claim 1 wherein a wager opportunity is present that provides odds for the pair of numbers at 4:1 on a single roll of the dice.

8. The method of claim 1 wherein odds for both a) and b) are offered, and odds for the hard 4, 6, 8, and 10 is between 6:1 and 8:1, and wherein odds for the pair of numbers is between 3:1 and 5:1.

9. A method of playing a game of craps wherein at least one player places a proposition wager on random events generated by dice, and random dice outcomes are provided, that method comprises providing a player at least one proposition wagering opportunity selected from the group consisting of a) a wager that the next roll of the dice will be a hard 4, 6, 8 or 10 and b) a wager that the next roll of the dice will be a pair of numbers; and a player placing a proposition wager on at least one of the at least one wagering opportunities.

10. The method of claim 9 wherein odds for the hard 4, 6, 8, and 10 is between 6:1 and 8:1.

11. The method of claim 10 wherein odds for a) are offered and odds for b) are not offered.

12. The method of claim 9 wherein odds for the pair of numbers is between 3:1 and 5:1.

13. The method of claim 12 wherein odds for b) are offered and odds for a) are not offered.

14. The method of claim 9 wherein odds at for the hard 4, 6, 8, and 10 is 7:1.

15. The method of claim 9 wherein odds for the pair of numbers is 4:1.

16. The method of claim 9 wherein odds for both a) and b) are offered and odds for the hard 4, 6, 8, and 10 is between 6:1 and 8:1, and wherein odds for the pair of numbers is between 3:1 and 5:1.

* * * * *